US007111347B1

(12) United States Patent
Cottrell

(10) Patent No.: US 7,111,347 B1
(45) Date of Patent: Sep. 26, 2006

(54) NURSING WEDGE

(75) Inventor: Annette Marie Cottrell, 5710 NE. 56th St., Seattle, WA (US) 98105

(73) Assignee: Annette Marie Cottrell, Seattle, WA (US)

( * ) Notice: Subject to any disclaimer, the term of this patent is extended or adjusted under 35 U.S.C. 154(b) by 0 days.

(21) Appl. No.: 11/107,717

(22) Filed: Apr. 18, 2005

(51) Int. Cl.
*A47G 9/10* (2006.01)

(52) U.S. Cl. ..... 5/655; 5/655.9; 5/953; 5/632; 5/490

(58) Field of Classification Search ..... 5/655, 5/655.9, 953, 652, 630, 632, 636, 643, 484, 5/490, 922
See application file for complete search history.

(56) References Cited

U.S. PATENT DOCUMENTS

| | | | | | |
|---|---|---|---|---|---|
| 2,314,080 | A * | 3/1943 | Dine et al. | 5/630 |
| 3,003,815 | A * | 10/1961 | Zinn | 297/118 |
| 3,284,817 | A * | 11/1966 | Landwirth | 5/647 |
| 3,333,286 | A * | 8/1967 | Biolik | 5/632 |
| 3,389,411 | A * | 6/1968 | Emery | 5/490 |
| 3,555,582 | A * | 1/1971 | Radford | 5/632 |
| 3,648,308 | A * | 3/1972 | Greenawalt | 5/632 |
| 3,938,205 | A * | 2/1976 | Spann | 5/632 |
| 4,193,150 | A * | 3/1980 | Vineberg | 5/632 |
| 4,214,326 | A * | 7/1980 | Spann | 5/632 |
| 4,233,700 | A * | 11/1980 | Spann | 5/632 |
| 4,441,221 | A * | 4/1984 | Enste et al. | 5/657 |
| 4,566,449 | A * | 1/1986 | Smith | 5/603 |
| 4,635,306 | A * | 1/1987 | Willey | 5/632 |
| 4,712,833 | A * | 12/1987 | Swanson | 297/228.12 |
| 4,862,535 | A * | 9/1989 | Roberts | 5/655 |
| 4,970,742 | A * | 11/1990 | Keener | 5/633 |
| 5,014,376 | A * | 5/1991 | Doran et al. | 5/603 |
| 5,029,351 | A * | 7/1991 | Weber | 5/655 |
| 5,133,098 | A * | 7/1992 | Weber | 5/655 |
| 5,432,967 | A * | 7/1995 | Raftery | 5/633 |
| 5,439,008 | A * | 8/1995 | Bowman | 128/875 |
| 5,448,790 | A * | 9/1995 | Saro et al. | 5/657 |
| 5,697,112 | A * | 12/1997 | Colavito et al. | 5/633 |
| 5,790,999 | A * | 8/1998 | Clark | 5/655 |
| 5,800,368 | A * | 9/1998 | Klingemann et al. | 602/1 |
| 6,292,964 | B1 * | 9/2001 | Rose et al. | 5/630 |
| 6,360,387 | B1 * | 3/2002 | Everhart | 5/630 |
| 6,931,683 | B1 * | 8/2005 | Elkin et al. | 5/655 |
| 2005/0198739 | A1 * | 9/2005 | Elkin et al. | 5/655 |

FOREIGN PATENT DOCUMENTS

| | | | |
|---|---|---|---|
| GB | 2237508 | A * | 5/1991 |

* cited by examiner

*Primary Examiner*—Robert G. Santos

(57) ABSTRACT

The nursing pillow is a firm foam wedge with feeding surfaces covered in softer, cushioning foam. The pillow itself supports baby and is angled to encourage proper elevation of baby's head necessary for good digestion and proper alignment of baby's mouth and mother's nipple. The outer layer of cushioning foam supports and cradles the baby while reducing the amount of effort required by the mother. The pillow has two covers: one waterproof inner cover and one removable, washable outer cover with a carrying handle.

3 Claims, 7 Drawing Sheets

NURSING WEDGE

FIELD OF INVENTION

The present invention relates to pillows for supporting infants during nursing.

BACKGROUND OF INVENTION

Breastfeeding can be a frustrating and uncomfortable experience for both baby and mother. Baby must be supported at a height that allows for proper alignment of mouth to nipple and allows for baby's head to be elevated at such a degree above his stomach to allow for proper digestion. Supporting baby with the frequency and duration of time required to breastfeed causes physical strain and fatigue, and many women have difficulty or fail to maintain the correct nursing position. In failing to maintain the correct position, mouth-nipple alignment may be compromised and many women may experience sore nipples.

The goal of a nursing pillow is to assist mother in nursing in the manner that is most comfortable. If baby experiences pain from frequent spit-up, reflux or poor digestion, if mother experiences physical strain and fatigue from supporting baby, or if mother experiences sore nipples due to improper mouth-nipple alignment, she may give up nursing baby. Most nursing pillows provide support for mother rather than baby, and a few are height adjustable, addressing proper mouth-nipple alignment but none provide full support for baby, height adjustability and proper incline for the baby.

U.S. Pat. No. 5,261,134, issued to Matthews, is a pillow designed to support infants. Although it is commonly used as a nursing pillow, the original intent of the patent was as a seating device and the design does not solve the issues of proper mouth-nipple alignment or head elevation. The design of the pillow is not height adjustable, requiring mother to support baby in such a fashion that baby's mouth is correctly aligned with her nipple, baby's head is properly elevated, and baby's back is not curved. In addition, the pillow is bulky and large and does not fit between the arms of most rockers or gliders commonly found in nurseries. The pillow and cover are not water resistant, requiring the user to launder the pillow itself which can result in degradation of the pillow structure. The method commonly used to employ the pillow as a nursing aid is to wrap the arms of the pillow around the wearer. Because the pillow comes in only one size there can be gaps between the wearer and pillow into which baby can roll. Finally, because the surface of the pillow is rounded, it creates an unstable surface on which baby can roll either towards or away from the wearer.

U.S. Pat. No. 5,581,833, issued to Zenoff, is a support pillow with lumbar support. Because the pillow is not height adjustable, it does not properly address the issue of correct mouth-nipple alignment. Further, the removable wedge is not of sufficient angle for proper digestion. When seated in a straight back chair the lumbar support of the pillow pushes the wearer's back forward, which encourages hunching and may compromise correct mouth-nipple alignment. The pillow's flat, hard surface provides minimal comfort and reduced stability for baby, requiring mother to additionally support baby while nursing, opening her up to stress and fatigue. Finally, when being removed, the Velcro enclosure creates sufficient noise to wake or startle baby, and is difficult to remove with one hand.

U.S. Pat. No. 5,029,351, issued to Weber, is a wedge-shaped support pillow that is slightly inclined to address mouth-nipple alignment and aid in proper digestion. The incline is described in the patent application as a "gentle slope" on a wedge which measures 20–30 inches in length by at most 9 inches in height. A gentle angle would be insufficient to address proper digestion. In addition, at 20–30 inches in length and 10–16 inches in width, the pillow would be much larger and more cumbersome to use than the present invention. The pillow is designed to support mother rather than baby. Finally, the patent makes no mention of the pillow or cover being water-resistant and does not have a carrying handle.

U.S. Pat. No. 6,651,282, issued to Skoug, Skattum, Gurli, Igoe, and Edward, is a bead-filled crescent shaped nursing pillow. The pillow does not address providing a firm support on an elevation sufficient to promote proper digestion. In addition, the pillow is much larger and bulkier in size than the present invention and does not have a carrying handle.

U.S. Pat. No. 6,564,408 issued to Van Vuuren, is a nursing pillow consisting of side arms, a mid portion, and back strap. Both top and bottom portions of the mid section are tapered at one end where the mid section attaches to one side arm. Both side arms, however, are approximately the same height so that once an infant's length surpasses the length of the mid section he would no longer be laying on an incline. According to the patent application, the pillow "preferably" includes an additional wedge-shaped piece that can be attached at the thinnest portion of the tapered end of the surface placed on the wearer's lap in order to create a flat surface. Without attaching this extra piece, the full pillow would not rest solidly on the lap of the user since the bottom surface would consist of two flat bottomed side arms and a tapered mid section which would be, in effect, higher than the side arms. To switch from one breast to the other and still maintain the angled feeding surface would require removing the extra wedge from the bottom surface and placing it on the top surface when flipping the pillow over, a task difficult to do while holding baby. In addition, the waist strap would need to be removed before flipping the pillow, also cumbersome while holding baby. Finally, the drawings show a pillow that is much larger and bulkier than the present invention.

Only a device such as a wedge or other that allows baby's height to be adjusted to the exact correct position for both his mouth and mother's nipple can ensure correct mouth-nipple alignment. Only a device that maintains baby in a semi-upright position can provide a nursing experience which promotes proper digestion.

The applicant's pillow addresses these plus additional shortcomings of previous nursing pillows:

Height: The angle of the wedge allows the user to slide the baby higher or lower in order to adjust to the user's individual needs, in effect making the pillow height adjustable. The height of a nursing pillow is unique to each individual and dependent on waist length, breast size, and infant size. Because the height of this nursing wedge is always appropriate, the wedge encourages proper mouth-nipple alignment.

Positions: The wedge can be placed across the lap or beside the wearer, allowing for multiple feeding positions including the cradle and the football hold. Because all sides of the wedge are encased in cushioning foam and it is symmetrical in shape, the wedge is reversible and can be flipped over or turned around to shift from one breast to the other. The wedge automatically places baby in a position similar to the natural nursing position, where a woman nurses an infant in a cradle position without a nursing pillow. Because baby and mother will be familiar with that position, it will be easier and more comfortable for both during those times when they are away from home and without a nursing pillow.

Health: The angle of the wedge allows baby to recline rather than lie flat while nursing. Proper digestion cannot occur while laying flat. For this reason many in the medical profession recommend that all infants should nurse on an angle. Babies who are prone to spitting up frequently or have reflux will especially benefit from this feeding position. In addition an upright position helps keep milk out of the inner ear, helping to prevent ear infections. Finally, pillows that do not have waterproof covers must be washed in order to prevent bacterial growth from urine and spit-ups. These pillows are large and bulky and difficult to wash so users wash them infrequently. It is also difficult to be sure the pillows have dried completely, and mold growth can occur if they have not.

Comfort: The comfort of both mother and baby will encourage longer, more productive and more enjoyable feeding sessions. If baby does not feel comfortable, secure or stable, he is not likely to nurse productively. Similarly, if mother is uncomfortable or fatigued from supporting baby the session will not be productive. The present invention supports baby rather than mother. More importantly, the discomfort from using a feeding pillow that is not designed to promote proper mouth-nipple alignment greatly reduces the odds that mother will continue to breastfeed.

Flexibility: Unlike other nursing pillows, a wedge allows for changes in baby's size. As baby gets longer and baby's head grows larger, the appropriate placement for baby on the nursing pillow will change. The wedge can be slid further to the right or left on mother's lap to allow for this change. The cushioning foam continues to stabilize the wedge on mother's lap. In addition, as baby's length surpasses other nursing pillows, the wedge can become a back support for baby on mother's lap. Thus baby will eventually simply sit on mother's lap and recline against the wedge for support and comfort while continuing to nurse in a position appropriate for proper digestion and mouth-nipple alignment. In addition, the absence of straps makes it possible to use the wedge in many different positions.

Ease of Use: The nursing wedge is of simple design and fairly compact in size in comparison with most nursing pillows. It fits between the arms of most rockers or gliders and can easily be carried by the carrying handle. It is one cohesive unit free of arms, waist straps, supplemental pieces, and noisy enclosures. It is the simplest and closest to the natural nursing position of all previous inventions.

BRIEF SUMMARY OF THE INVENTION

The present invention is a wedge-shaped foam nursing pillow with a cushioning foam encasing. The pillow has an inner waterproof cover removable and a removable outer cover with a carrying handle attached. The nature of the wedge shape in effect makes the pillow height adjustable by positioning baby higher or lower on the pillow surface, allowing for proper mouth-nipple alignment. Also by nature of the wedge shape baby's head is elevated in the position most recommended to enable proper digestion. Finally, the wedge itself supports baby, relieving mother of the physical strain and fatigue associated with supporting baby during nursing. Several possible variations of the pillow are further discussed.

DETAILED DESCRIPTION OF THE INVENTION

Figure 1:
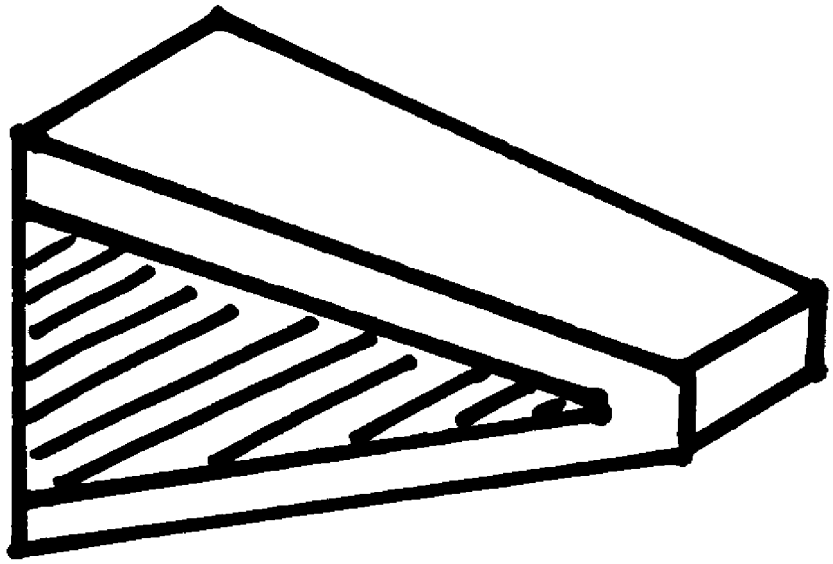
FIG. 1 is a side perspective view showing the inner wedge made of firm, supportive foam with feeding surfaces covered by a softer, cushioning foam.
Figure 2:
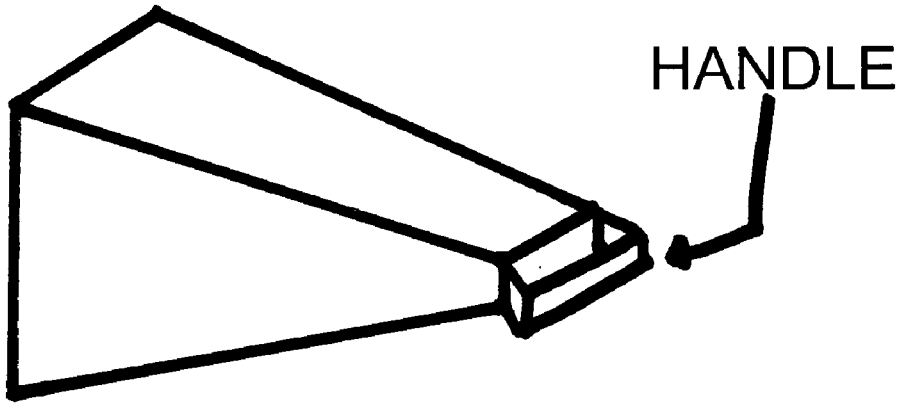
FIG. 2 is a side perspective view showing the handle and approximate shape and angle of the wedge.
Figure 3:
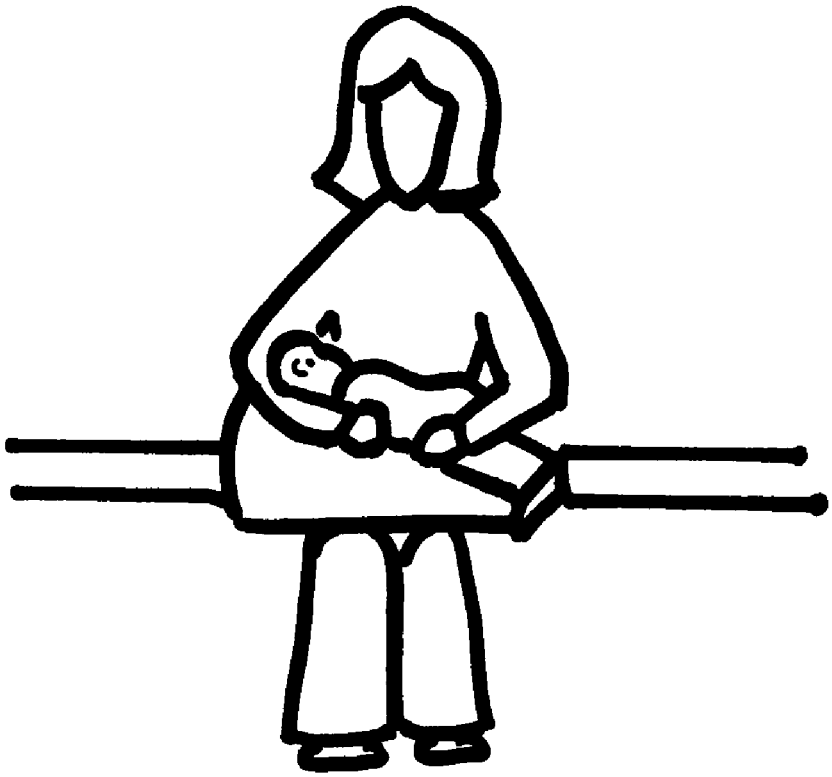
FIG. 3 is a perspective view showing the mother employing the wedge on her lap in a modified cradle hold.
Figure 4:
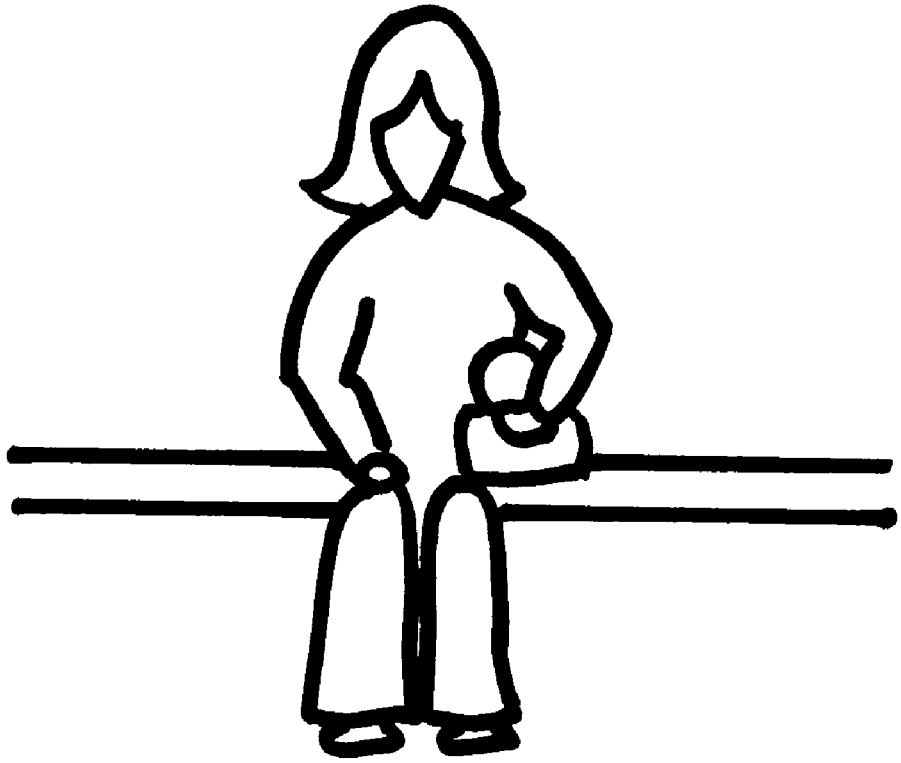
FIG. 4 is a perspective view showing the mother employing the wedge beside her in the football hold.
Figure 5:
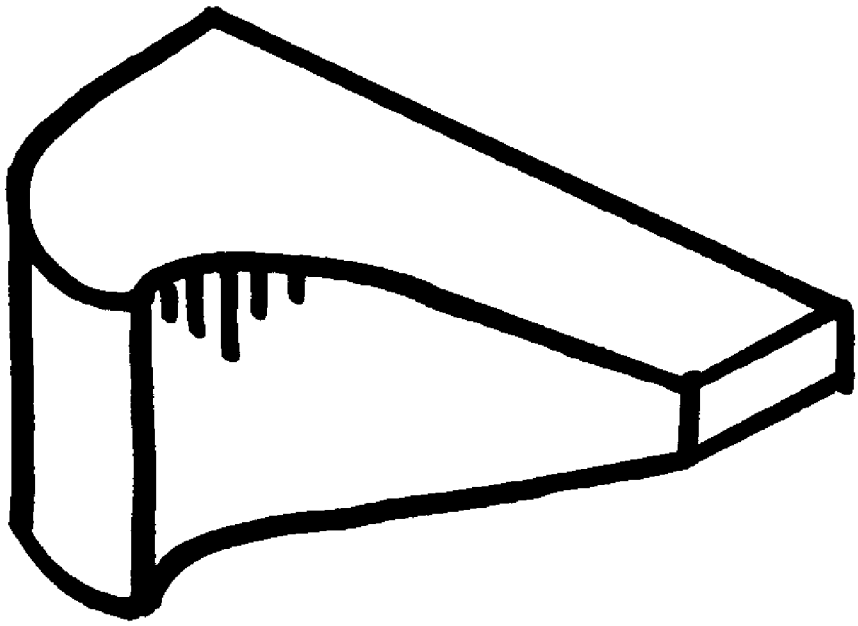
FIG. 5 is a side perspective view of a possible variation on the present invention whereby the wedge has a section of moldable foam that wraps around one side of the mother's waist.
Figure 6:
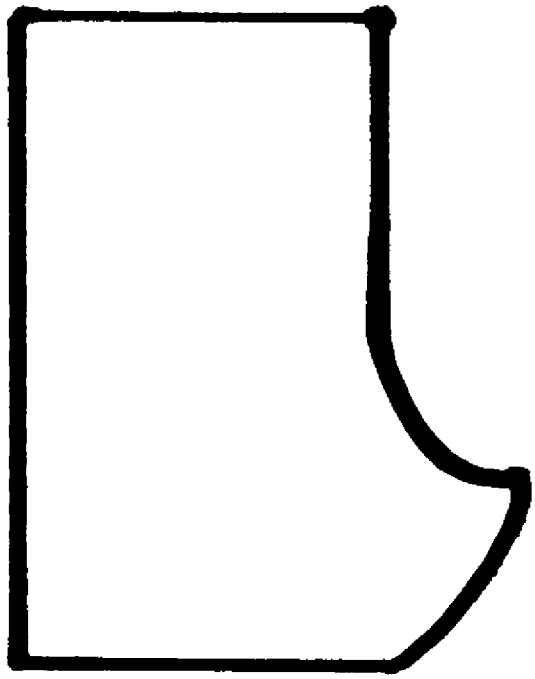
FIG. 6 is a top or bottom perspective view of the same possible variation with a section of moldable foam that wraps around one side of the mother's waist.
Figure 7:
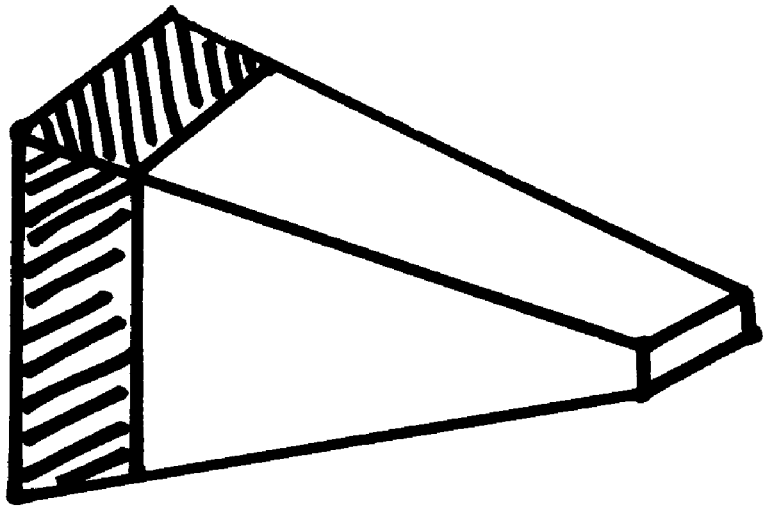
FIG. 7 is a side perspective view of yet another possible variation on the present invention whereby there is a supplemental end cap that can be attached to the wedge to increase the height and length of the wedge if desired.

The present invention is an isosceles triangle constructed of firm, supportive foam encased in an outer layer of cushioning foam covering the feeding surfaces of the pillow. The foam serves the purpose of creating a comfortable and stable surface that will not easily slide off the lap of the wearer, and that baby will not easily slide off of.

The feeding surfaces of the pillow are approximately 15 to 17 inches in length and between 7 and 10 inches in width. The thickest end of the wedge is between 6 and 9 inches high with the thinnest end of the wedge approximately between 1 and 3 inches high. The angle of the feeding surface is approximately between 22 and 30 degrees, however, by placing the wedge on one leg only and raising that leg slightly it is possible to comfortably create a more aggressive angle for even better digestion if desired.

The pillow is employed by placing baby upon pillow and pillow either upon mother's lap tightly abutting her waist and nursing in a style commonly referred to as the cradle hold, or placing pillow on a surface beside mother, tightly abutting her side and nursing in a style commonly referred to as the football hold. The pillow can also be employed to bottle feed or to cuddle with baby at times when baby is digesting a feeding and needs to remain on an angle. These are simple examples and not meant to be an exhaustive list of all methods of employment for the present invention.

The pillow has two covers. The inner cover prohibits bacterial growth within the pillow due to milk leakage, spit-up or urination, and also makes it unnecessary to wash the pillow itself. Attached to the outer cover is a carrying handle, making it easy to carry the pillow with one hand while holding baby. The outer cover is enclosed by means of a zipper.

One possible variation of the wedge includes a slight extension of molding foam angling out from one of the side sections at the highest end of the wedge which would wrap around mother's waist on one side, providing extra stability while using the cradle hold and extra surface area while using the football hold. Yet another possible variation of the wedge includes a removable end cap that would extend the wedge at its highest end, making it even longer and higher when the extra piece is attached. Yet another possible variation is to produce the wedge in custom sizes while maintaining the same incline.

The invention claimed is:

1. A nursing pillow which supports baby rather than mother and encourages both proper mouth-nipple alignment and an angle necessary for proper digestion, the nursing pillow comprising:

a wedge having the cross-section of an isosceles triangle and constructed of firm, supportive foam encased in an outer layer of cushioning foam;

the wedge measuring approximately 15 to 17 inches in length and between 7 and 10 inches in width;

the thickest end of the wedge is between 6 and 9 inches high with the thinnest end of the wedge approximately between 1 and 3 inches high;

the angle of the top surface of the wedge relative to the bottom surface is approximately between 22 and 30 degrees;

the cushioning foam is fully attached to the inner foam wedge such that all materials form one cohesive unit;

the cushioning foam covers the outer surfaces of the wedge;

an inner cover constructed of waterproof fabric, prohibiting bacterial growth within the pillow due to milk leakage, spit-up or urination and also making it unnecessary to wash the pillow itself;

a removable outer cover constructed of a soft washable fabric and attached to the outer cover is a carrying handle, making it easy to carry the pillow with one hand while holding baby.

2. A nursing pillow which supports baby rather than mother and encourages both proper mouth-nipple alignment and an angle necessary for proper digestion, the nursing pillow comprising:

a wedge having the cross-section of an isosceles triangle and constructed of firm, supportive foam encased in an outer layer of cushioning foam;

the wedge measuring approximately 15 to 17 inches in length and between 7 and 10 inches in width;

the thickest end of the wedge is between 6 and 9 inches high with the thinnest end of the wedge approximately between 1 and 3 inches high;

the angle of the top surface of the wedge relative to the bottom surface is approximately between 22 and 30 degrees;

the cushioning foam is fully attached to the inner foam wedge such that all materials form one cohesive unit;

the cushioning foam is attached to the outer surfaces of the wedge;

the wedge includes a slight extension of molding foam angling out from one of the side sections at the highest end of the wedge which would curve partially around mother's waist on one side, providing extra stability while using the cradle hold and extra surface area while using the football hold;

the foam extension may or may not be attachable to the wedge by means of a hook and loop closure system;

if the foam extension is removable the extension would either have its own cover constructed of the same fabric as a removable outer pillow cover, or would come with an additional cover of suitable size to encompass both the extension and the wedge when attached, forming one new cohesive pillow;

an inner cover constructed of waterproof fabric, prohibiting bacterial growth within the pillow due to milk leakage, spit-up or urination and also making it unnecessary to wash the pillow itself;

the removable outer cover being constructed of a soft washable fabric attached to the outer cover is a carrying handle, making it easy to carry the pillow with one hand while holding baby.

3. A nursing pillow which supports baby rather than mother and encourages both proper mouth-nipple alignment and an angle necessary for proper digestion, the nursing pillow comprising:

a wedge having the cross-section of an isosceles triangle and constructed of firm, supportive foam encased in an outer layer of cushioning foam;

the wedge measuring approximately 15 to 17 inches in length and between 7 and 10 inches in width;

the thickest end of the wedge is between 6 and 9 inches high with the thinnest end of the wedge approximately between 1 and 3 inches high;

the angle of the top surface of the wedge relative to the bottom surface is approximately between 22 and 30 degrees;

the cushioning foam is fully attached to the inner foam wedge such that all materials form one cohesive unit;

the cushioning foam covers the outer surfaces of the wedge;

the wedge includes a removable end cap that would extend the wedge at its highest end, making it increasingly longer and higher when the extra piece is attached;

the additional end cap would attach to the body of the wedge using a hook and closure system, and would either have its own cover constructed of the same fabric as a removable outer pillow cover, or would come with an additional cover of suitable size to encompass both the end cap and the wedge when attached, forming one new cohesive pillow;

an inner cover constructed of waterproof fabric, prohibiting bacterial growth within the pillow due to milk leakage, spit-up or urination and also making it unnecessary to wash the pillow itself;

the removable outer cover being constructed of a soft washable fabric attached to the outer cover is a carrying handle, making it easy to carry the pillow with one hand while holding baby.

* * * * *